US005122413A

United States Patent [19]

Ohno et al.

[11] Patent Number: 5,122,413

[45] Date of Patent: Jun. 16, 1992

[54] SUPPORT FOR THERMOSENSITIVE RECORDING

[75] Inventors: Akihiko Ohno; Akira Iwai, both of Ibaraki, Japan

[73] Assignee: Oji Yuka Goseishi Co., Ltd., Tokyo, Japan

[21] Appl. No.: 756,710

[22] Filed: Sep. 9, 1991

[30] Foreign Application Priority Data

Sep. 11, 1990 [JP] Japan ..... 2-240994
Sep. 11, 1990 [JP] Japan ..... 2-240995

[51] Int. Cl.[5] ..... B41N 5/18

[52] U.S. Cl. ..... 428/319.9; 428/480; 428/323; 428/220; 503/200

[58] Field of Search ..... 503/200; 428/319.9, 428/480

[56] References Cited

U.S. PATENT DOCUMENTS 4,996,182 2/1991 Matsui et al. ..... 503/200

FOREIGN PATENT DOCUMENTS 0234563 9/1987 European Pat. Off. .
0345419 12/1989 European Pat. Off. .
0434073 6/1991 European Pat. Off. .

OTHER PUBLICATIONS

Patent Abstracts of Japan, vol. 14, No.196 (M-964)(4139) 20 Apr. 1990.
Patent Abstracts of Japan, vol. 13, No. 305 (M-849)(3653) 13 Jul. 1989.

*Primary Examiner*—Edith L. Buffalow
*Attorney, Agent, or Firm*—Sughrue, Mion, Zinn, Macpeak & Seas

[57] ABSTRACT

A support for a thermosensitive recording material comprising a surface layer of a thermoplastic resin film having a center line average roughness of 0.6 μm or less laminated on the surface of a porous film base material of a biaxially stretched film of a thermoplastic resin containing an inorganic fine powder, wherein the properties of said support meet the following conditions (a) to (c);

(a) the thickness of the surface layer is from 0.3 to 2.0 μm and the Bekk smoothness of the surface layer is from 1,000 to 8,000 seconds, (b) the opacity of the support is at least 70%, the density of the support is 0.91 g/cm$^3$ or less, and the compression ratio of the support under a stress of 32 kg/cm$^2$ is from 15 to 35%, and (c) the coefficient of thermal shrinkage at 120° C. for 30 minutes is 2.5% or less in the longitudinal direction and is 2.0% or less in the width direction.

A support for a thermosensitive recording material comprising a surface layer composed of a thermoplastic resin film having a center line average roughness of 0.6 μm or less laminated on one surface, as a front surface, of a porous film base material of a biaxially stretched film of a thermoplastic resin containing an inorganic fine powder and a surface layer of a thermoplastic resin film having a kinetic friction coefficient of from 0.3 to 1.2 laminated on the opposite surface, as a back surface layer, of the base material, wherein the properties of said support meet the following conditions (a) to (d);

(a) the thickness of the front surface layer is from 0.3 to 2.0 μm and the Bekk smoothness of the front surface layer is from 1,000 to 8,000 seconds, (b) the opacity of the support is at least 70%, the density of the support is 0.91 g/cm$^3$ or less and the compression ratio of the support under a stress of 32 kg/cm$^2$ is from 15 to 35%, (c) the coefficient of thermal shrinkage at 120° C. for 30 minutes is 2.5% or less in the longitudinal direction and is 2.0% or less in the width direction, and (d) the thickness of the back surface layer is from 0.3 to 2.0 μm.

2 Claims, 1 Drawing Sheet

SUPPORT FOR THERMOSENSITIVE RECORDING

FIELD OF THE INVENTION

The present invention relates to a support for a dye transfer type thermosensitive recording sheet (dye transfer type thermosensitive image receiving sheet), and more particularly, the invention relates to a support for thermosensitive recording, which has excellent resolving power, provides clear images having a high density, and does not cause curling due to heat even after printing.

Furthermore, the invention relates to a support for thermosensitive recording, which has a good slidability at the back surface, can be used for high speed printing, has excellent resolving power, provides a clear image having a high density, and does not cause curling by heat even after printing.

BACKGROUND OF THE INVENTION

A thermosensitive recording process is a recording process using heat generated by a thermosensitive recording head (hereinafter, is referred to simply as a head) in accordance with input signals, this causes a fusion contact between a color developer and a color former on an image receiving sheet in contact with the head, whereby color images are obtained. The speed of the thermosensitive recording process is dependent on the quantity of information capable of being transmitted using a telephone circuit. Moreover, this process provides a primary coloring system without need of development and fixing steps, and since the wear and tear of the head are very less, the process has been rapidly spreading to applications in information processing equipment such as printers, facsimile machines, etc.

Moreover, the development of various kinds of office devices and variety of uses for these devices have rapidly progressed and hence the development of a thermosensitive recording material capable of meeting each requirement has been needed. For example, as a thermosensitive recording material capable of meeting the increase of the speed of a recording device, a thermosensitive recording material capable of giving clear images having a high density even using only a small amount of printing energy has been required. To meet the demand, it has been necessary to investigate not only the thermosensitive recording layer but also the support, and use of synthetic resin films as the support in place of conventional ordinary papers has increased.

For example, as a thermosensitive recording material using a resin film containing an inorganic fine powder, a thermosensitive recording material using a biaxially stretched resin film layer having fine voids, the content of the fine voids being from 40 to 100 cc/100 g, as one element of the support for a thermosensitive recording layer and a thermosensitive recording material wherein on this type of biaxially stretched resin film layer is further laminated a film layer having the same material as the foregoing resin film or a different material therefrom are disclosed in U.S. Pat. 4,996,182 and JP-A-2-70479 (the term "JP-A" as used herein means an "unexamined published Japanese patent application").

However, in using the resin film layer meeting such voids, a support for thermosensitive recording, which has excellent resolving power, provides clear images having a high density, and where curling due to heat even after printing does not occur can not be obtained.

Accordingly, for obtaining clear images having a high density, it is necessary to improve the smoothness of the surface, which is property other than voids.

Thus, reducing the compounding amount of the inorganic fine powder for improving the surface smoothness of the support has been attempted but in this case, the amount of voids in the film formed by stretching is decreased to reduce the cushioning property and lower the density of images formed. Therefore, the foregoing problem could not be solved in the manner tried.

Also, with the recent marked increase in the amount of information, high-speed recording devices (requiring about 10 seconds of a recording time for an A4-size page (210 mm×297 mm) has been developed in place of the earlier so-called low-speed recording devices (requiring about 3 minutes of the recording time for an A4-size sheet), and further ultrahigh-speed devices have been investigated. With the tendency toward an increase in the recording speed, it was attempted to increase the compounding amount of an inorganic fine powder in an inorganic fine power-containing resin film for roughening the back surface to lubricate the back surface. However, the amount of voids of the film formed by stretching in this approach is increased and the surface smoothness is reduced. This results in lowering the density of the images formed. Thus clear images having an excellent resolving power and a high density can not be obtained at high speed.

SUMMARY OF THE INVENTION

As the result of various investigation for solving the foregoing problems, the inventor has discovered that a support formed by laminating as a surface layer a biaxially stretched thin layer film having improved smoothness on the surface of a biaxially stretched porous film base material having a cushioning property and a restrained shrinkage to heat can be used as the support for thermosensitive recording capable of providing clear images having an excellent resolving power and having a high density even using a small printing energy and without curling due to heat even after printing occurring and have succeeded in accomplishing a first embodiment of this invention based on the discovery.

Furthermore, it has further been discovered that a support obtained by further laminating as a backing layer a thin layer film of a thermoplastic resin having a kinetic friction coefficient of from 0.3 to 1.2 on the back surface of the above-described base material (support) can be used as the support for thermosensitive recording having a good sliding property for the back surface, capable of being used for high-speed printing, providing clear images having an excellent resolving power and having a high density even using a small printing energy, and without curling by heat even after printing occurring, and a second embodiment of this invention has been developed.

That is, a first embodiment of this invention comprises support for a thermosensitive recording material comprising a thermoplastic resin film having a center line average roughness of not more than 0.6 μm laminated as a surface layer on the surface of a porous film base material of a biaxially stretched film of a thermoplastic resin containing an inorganic fine powder, where the properties of the support meet the following conditions of from (a) to (c);

(a) the thickness of the surface layer is from 0.3 to 2.0 μm and the Bekk smoothness thereof is from 1,000 to 8,000 seconds, (b) the opacity of the support is at least 70%, the density thereof is not more than 0.91 g/cm$^3$, and the compression ratio under a stress of 32 kg/cm: is from 15 to 35%, and (c) the coefficient of thermal shrinkage at 120° C. for 30 minutes is not more than 2.5% in the MD direction (longitudinal direction) and not more than 2.0% in the TD direction (width direction).

A second embodiment of this invention comprises a support for a thermosensitive recording material comprising a surface layer composed of a thermoplastic resin film having a center line average roughness of not more than 0.6 μm laminated on one surface, as a front surface, of a porous film base material of the biaxially stretched film of a thermoplastic resin containing an inorganic fine powder and a surface layer composed of a thermoplastic resin film having a kinetic friction coefficient of from 0. 3 to 1.2 laminated on the opposite surface, as a back surface layer, of the base material, where the properties of the support meet the following conditions of from (a) to (d);

(a) the thickness of the front surface layer is from 0. 3 to 2.0 μm and the Bekk smoothness (JIS P-8119) of the front surface layer is from 1,000 to 8,000 seconds, (b) the opacity of the support is at least 70%, the density thereof is not more than 0.91 g/cm$^3$, and the compression ratio under a stress of 32 kg/cm$^2$ is from 15 to 35%, and (c) the coefficient of thermal shrinkage of the support at 120° C. for 30 minutes is not more than 2.5% in the MD direction and not more than 2.0% in the TD direction, and (d) the thickness of the back surface layer is from 0. 3 to 2.0 μm.

A thermosensitive recording material using the support for thermosensitive recording of the present invention can be used to print at a high speed, has excellent surface smoothness, has excellent cushioning properties due to the many microvoids present in the support, whereby the adhesion of the thermosensitive recording material with a printing head is improved to provide transferred images with enhanced gradation.

Furthermore, since the coefficient of the thermal shrinkage of the support is low, the thermosensitive recording material does not curl even after printing.

DETAILED DESCRIPTION OF THE INVENTION

Figure 1:
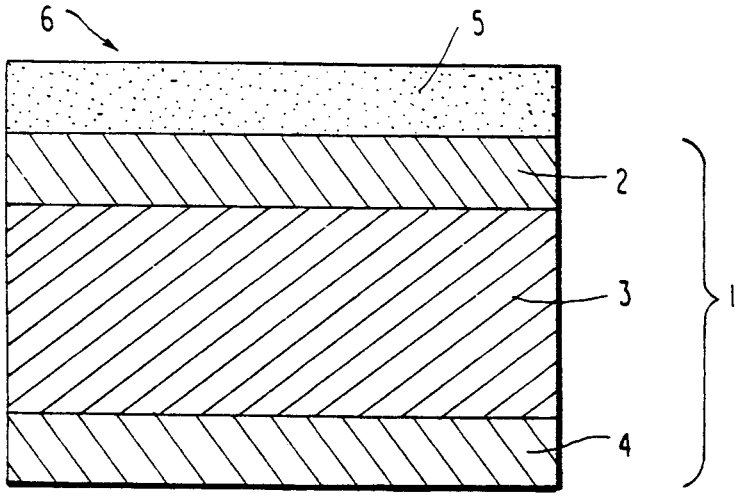
FIG. 1 is a sectional view showing an example of the thermosensitive recording material using the support for thermosensitive recording of this invention.

The invention is described in detail below.

[I] Support for Thermosensitive Recording

(1) Construction

The support for a thermosensitive recording material of the first embodiment of the present invention has a structure such that a surface layer comprising a thermoplastic resin film having a center line average roughness of not more than 0.6 μm, and preferably not more than 0.5 μm, is laminated on the surface of a porous film base material of a biaxially stretched film of a thermoplastic resin containing an inorganic fine powder and the properties thereof are;

(a) the thickness of the surface layer is from 0. 3 to 2.0 μm, preferably from 0.5 to 1.5 μm and the Bekk smoothness thereof is from 1,000 to 8,000 seconds, and preferably from 2,000 to 7,000 seconds, (b) the opacity of the support is at least 70%, and preferably at least 80%, the density thereof is not more than 0.91 g/cm$^3$, and preferably not more than 0.86 g/cm$^3$, and the compression ratio thereof under a stress of 32 kg/cm$^2$ is from 15 to 35%, and preferably from 20 to 30%, and (c) the coefficient of thermal shrinkage at 120° C. for 30 minutes is not more than 2.5%, and preferably not than 2.0% in the MD direction and is not more than 2.0%, and preferably not more than 1.5% in the TD direction.

This provides a double layer structure thermoplastic resin film using a polyolefin biaxially stretched film containing from 15 to 45% by weight of an inorganic fine powder as the base material layer having laminated on the surface of the base material layer as the outermost surface layer a biaxially stretched polyolefin film substantially containing an inorganic fine powder in an amount appropriate for the desired quality at a thickness of from 0. 3 to 2.0 μm, the opacity by JIS-P8138 being at least 70%, the whiteness by JIS-P8123 being at least 85%, and the density being not more than 0.91 g/cm$^3$, and further the center line average roughness (Ra) of the surface layer is not more than 0.6 μm measured by JIS-B0601, the Bekk smoothness measured by JIS P-8119 is from 1,000 to 8,000 seconds, and the compression ratio (i.e., the compressed amount in the case of applying a load of 32 kg/cm$^2$) of the support is from 15 to 35%.

The support for thermosensitive recording in the second embodiment of the present invention has a structure that a back surface layer composed of a thermoplastic resin film having a kinetic friction coefficient of from 0. 3 to 1.2 , the preferably from 0.5 to 1.1, is laminated on the back surface of the porous film base material composed of a biaxially stretched film of a thermoplastic resin containing an inorganic fine powder as in the first embodiment of the present invention. The thickness of the back surface layer is from 0. 3 to 2.0 μm, and preferably from 0.5 to 1.5 μm.

(2) Constituting Elements

A polyolefin is usually used as the thermoplastic resin which is used for the foregoing base material layer, front surface layer, and back surface layer.

Examples of polyolefins include polyethylene, polypropylene, an ethylene/propylene copolymer, an ethylene/vinyl acetate copolymer, a propylene/butene-1copolymer, poly(4-methyl-pentene-1), polystyrene, etc.

As a matter of course, other thermoplastic resins such as polyamides, polyethylene terephthalate, polybutylene phthalate, etc., can be used but polypropylene series resins are preferred from the economical view point.

Typical inorganic fine powders which can be used in the foregoing base material layer and back surface layer include powders of calcium carbonate, calcined clay, diatomaceous earth, talc, titanium oxide, barium sulfate, aluminum sulfate, silica, etc., each having a mean particle size of not larger than 10 μm. In particular, a powder having a mean particle size of 0.1 to 4 μm is suitable for providing a center line average roughness (Ra) of the surface layer in the range of below 0.6 μm.

The appropriate kinetic friction coefficient of the back surface layer of from 0. 3 to 1.2 (J-TAPPI, Paper and Pulp Test method No. 30) can be achieved by increasing the content of the inorganic fine powder but if the thickness is much thicker than 2.0 μm, both sides are unbalanced and curling occurs. On the other hand, if the thickness of the back surface layer is thinner than 0. 3 μm, the kinetic friction coefficient is not sufficiently reduced. Thus, it is important for the thickness of the back surface layer to be from 0. 3 to 2.0 μm. For this purpose, when the inorganic fine powder is a powder of, for example, heavy calcium carbonate having a mean particle size of 1.5 μm, it is necessary that the amount of the powder compounded in the resin is at least 25% by weight.

If the foregoing kinetic friction coefficient is less than the above-described range, the sliding property is increased, while if the kinetic friction coefficient is larger than the range, the sliding property is reduced. In both cases, a problem that high-speed printing can not be achieved occurs.

(3) Structure:

A sectional view of an example of the structure of the thermosensitive recording material using the support for thermosensitive recording of this invention described above is shown in FIG. 1.

The support 1 shown in FIG. 1 is shown as a laminating biaxially stretched film of a three-layer structure composed of an outermost surface layer 2 of a biaxially stretched polypropylene film, a base material layer 3 of a biaxially stretched porous polypropylene film containing an inorganic fine powder, and a back surface layer 4 of a biaxially stretched polypropylene film. By forming a thermosensitive recording layer 5 on the foregoing surface layer 2, a thermosensitive recording material is formed.

The support 1 for thermosensitive recording of the present invention may include other layers in addition to the base material layer 3, the surface layer 2 and the back surface layer 4, such as, for example, a packing layer composed of a pulp paper or polyethylene terephthalate, paper-like layer or a back surface layer composed of a uniaxially stretched polypropylene film containing an inorganic fine powder, etc.

If the thickness of the outermost surface layer 2 is too thick, the Bekk smoothness is improved but the voids in the support 1 are decreased reducing the compressibility of the support and reducing the color density. On the other hand, if the thickness of the outermost surface layer 2 is thinner than 0. 3 μm, the Bekk smoothness of the outermost surface layer 2 is reduced as a result of the influence of the inorganic fine powder projecting from on the surface of the base material layer 3, whereby the density when the pulse width is narrow at high-speed printing becomes low. The Bekk smoothness is at least 1,000 seconds, and preferably at least 2,000 seconds and as the Bekk smoothness increases, the color density is higher and printing can be applied at a higher speed. However, since a Bekk smoothness which is too high sometimes causes sticking to occur, which results in lowering the color density, the upper limit of the Bekk smoothness is 8,000 seconds.

The opacity of the support 1 is at least 70%. The higher the opacity, the higher the image contrast, which makes the image more perceptible.

There is a correlation between the density and the compression ratio of the support 1 and as the number of micro voids increases, the density of the support decreases but the compression ratio becomes higher. The amount of voids of the support 1 is from 18 to 55%. The amount of the voids (v) can be calculated from the density ($\rho_o$) of the film before stretching and the density ($\rho$) of the film after stretching by the following equation.

$$v = \frac{\rho o - \rho}{\rho o} \times 100\ (\%)$$

As the density (JIS P-8118) of the support 1 decreases or the compression ratio of the support increases, the contact between the thermosensitive recording sheet and a head becomes excellent and the color density increases. However, if the compression ratio is too high, the density becomes too low, and the support loses its bending strength as a thermosensitive recording paper or sheet. Also, if the compression ratio is too low, the support loses its cushioning property and the color density is reduced.

[II] Production of Support for Thermosensitive Recording

The support 1 for thermosensitive recording of this invention can be produced by melt-kneading each of, for example, a thermoplastic resin containing from 0 to 5% by weight of an inorganic fine powder and a thermoplastic resin containing from 15 to 45% by weight an inorganic fine powder, each in separate extruder, supplying these thermoplastic resins, after has been each melt-kneaded, to one die, wherein they are laminated in molten states, co-extruding the laminate from the die, cooling them to a temperature of from 30 to 100° C. lower than the melting point of the thermoplastic resin, heating again the laminate to a temperature near the melting point of the thermoplastic resin, and then biaxially stretching the laminate from 3 to 8 times in the longitudinal direction (MD direction) and from 3 to 12 times in the width direction (TD direction) either successively or simultaneously.

Also, by increasing the annealing treatment temperature condition, the thermal shrinkage of the film can be restrained.

The thermal shrinkage of the support is preferably 2.5% or lower in the MD direction and 2.0% or lower in the TD direction, and is more preferably 2.0% or lower in the MD direction and 1.5% or lower in the TD direction. If the thermal shrinkage of the support is outside the foregoing ranges, the support tends to curl after printing.

[III] Production of Thermosensitive Recording Material (1) Compounding Agents:

By forming a thermosensitive recording layer 5 containing a color former and a developer on the support 1 obtained as described above, a thermosensitive recording material 6 is formed. The combination of the color former and the developer present in the thermosensitive recording layer 5 can be any combination wherein both components are brought into contact with each other to produce a coloring reaction. For example, a combination of a colorless or light-color basic dye and an inorganic or organic acidic substance and a combination of a metal salt of a higher fatty acid such as ferric stearate, etc., and a phenol such as gallic acid can be employed. Furthermore, a combination of a diazonium compound, a coupler, and a basic substance can be also used.

Color Former

Examples of colorless or light color basic dye which can be used as the color former in the thermosensitive recording layer 5 include various types of known compounds. Examples thereof are triallylmethane dyes such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindol-3-yl) phthalide, 3-(p-dimethylaminophenyl)-3-(2-methylinidol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide, 3-p-dimethylaminophenyl-3-(1-methylpryrrol -3-yl)-6-dimethylaminophthalide, etc.; diphenylmethane dyes such as 4,4'-bis-dimethylaminobenzhydryl benzyl ether, N-halophenyl-leucoauramine, N-2,4,5-trichlorophenyl-leucoauramine, etc.; thiazine dyes such as benzoyl leucomethylene blue, p-nitrobenzoyl leuco-methylene blue, etc.; spiro dyes such as 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho(6'-methoxybenzo)spiropyran, 3-propyl-spiro-dibenzopyran, etc.; lactam dyes such as Rhodamine-B anilinolactam, Rhodamine(p-nitroanilino)lactam, Rhodamine(o-chloroanilino)lactam, etc.; and fluoran dyes such as 3-dimethylamino-7-methoxy-fluoran, 3-dimethylamino-6-methoxyfluoran, 3-diethylamino-7-methoxy-fluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfuoran, 3-di-ethylamino-7-N-acetyl-N-methylaminofluoran, 3-diethylaminofluoran, 3-diethylamino-7-N-methyl-N-benzylaminofluoran, 3-diethylamino-7-N-chloroethyl-N-methylaminofluoran, 3-diethylamino-7-N-diethylam:inofluoran, 3-(N-ethyl-p-toluidino)-6-methyl-7-phenylaminofluoran, 3-(N-cyclopentyl-N-ethylamino)-6-methyl-7-anilinofluoran, 3-(N-ethyl-p-toluidino)-6-methyl-7-(p-toluidino)fluoran, 3-diethylamino-6-methyl-7-phenylaminofluoran, 3-diethyl-amino-7-(2-carbomethoxyphenylamino) fluoran, 3-(N-ethyl-N-isoamylamino)-6-methyl-7-phenylamino-fluoran, 3-(N-cyclo-hexyl-N-methylamino)-6-methyl-7-phenylaminofluoran, 3-piperidino-6-methyl-7-phenylaminofluoran, 3-piperidino-6-methyl-7-xylidino-fluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-N-methyl-N-tetrahydrofurfurylamino-6-methyl-7-anilinofluoran, 3-N-ethyl-N-tetrahydrofurfuryl-amino-6-methyl-7-anilinofluoran, etc.

Developer

Various kinds of substances are known as an inorganic or organic acidic substance which causes a coloration on contact with the foregoing basic dye.

Examples of inorganic acidic substances include active clay, acid clay, attapulgite, bentonite, colloidal silica, and aluminum silicate.

Examples of organic acidic substances which can be used are phenolic compounds such as 4-tert-butylphenol, 4-hydroxydiphenoxide, α-naphthol, β-naphthol, 4-hydroxyacetophenol, 4-tert-octyl-catechol, 2,2'-dihydroxydiphenol, 2,2'-methylene-bis(4-methyl-6-tert-isobutylphenol), 4,4'-isopropylidene-bis(2-tert-butylphenol), 4,4'-sec-butylidenediphenol, 4-phenyl-phenol, 4,4'-isopropylidenediphenol (bisphenol A), 2,2'-methylenebis(4-chlorophenol), hydroquinone, 4,4'-cyclohexylidenediphenol, benzyl 4-hydroxybenzoate, dimethyl 4-hydroxyphthalate, hydroquinone monobenzyl ether, novolak phenol resins, phenol polymers, etc.; aromatic carboxylic acids such as benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropyl-salicylic acid, 3-tert-butylsalicylic acid, 3-benzylsalicylic acid, 3-(α-methylbenzyl)salicylic acid, 3-chloro-5-(α-methylbenzyl)salicylic acid, 3,5-di-tertbutylsalicylic acid, 3-phenyl-5-(α,α-dimethylbenzyl)-salicylic acid, 3,5-di-α-methylbenzylsalicylic acid, etc.; and the salts of the foregoing phenolic compounds or aromatic carboxylic acids and polyvalent metals such as zinc, magnesium, aluminum, calcium, titanium, manganese, tin, nickel, etc.

Weight Ratio

The above-described basic dyes (color formers) and developers can be used, if desired, as a combination of two or more thereof. Also, the amount of the basic dye and the developer being used is suitably selected depending on the kinds used and there is no particular restriction on the ratio. However, in general, from 1 to 20 parts by weight, preferably from 2 to 10 parts by weight of the developer is used per part by weight of the basic dye.

(2) Coating Composition:

The coating composition containing these substances is generally prepared by uniformly or separately dispersing the basic dye (color former) and the developer in water as a dispersion medium by a stirring and grinding using means such as a ball mill, an attritor, a sand mill, etc.

The coating composition generally contains a binder such as starches, hydroxyethyl cellulose, methyl cellulose, carboxymethyl cellulose, gelatin, casein, gum arabic, polyvinyl alcohol, acetoacetyl group-modified polyvinyl alcohol, a diisobutylene/maleic anhydride copolymer salt, a styrene/maleic anhydride copolymer salt, an ethylene/acrylic acid copolymer salt, a styrene/butadiene copolymer emulsion, a urea resin, a melamine resin, an amide resin, an amino resin, etc., in an amount of from about 2 to 40% by weight, and preferably from about 5 to 25% by weight of the total solid components.

Other Compounding

Furthermore, the coating composition can contain various kind of assistants if desired and examples thereof are dispersing agents such as sodium dioctylsulfosuccinate, sodium dodecylbenzenesulfonate, lauryl alcohol sulfuric acid ester sodium salt, fatty acid metal salt, etc.; ultraviolet absorbent such as benzophenone ultraviolet absorbent, etc.; as well as defoaming agents, fluorescent dyes, coloring dyes, electroconductive substances, etc.

Also, if desired, waxes such as zinc stearate, calcium stearate, polyethylene wax, carnauba wax, paraffin wax, ester wax, etc.; fatty acid amides such a stearic acid amide. stearic acid methylenebisamide, oleic acid amide, palmitic acid amide, coconut fatty acid amide, etc.; hindered phenols such as 2,2'-methylenebis(4-methyl-6-tert-butylphenol), 1,1,3-tris(2-methyl-4-hydroxy-5-tert-butylphenyl)butane, etc.; ultraviolet absorbent such as 2-(2'-hydroxy-5'-methylphenyl)benzotriazole, 2-hydroxy-4-benzyloxybenzophenone, etc.; esters such as 1,2-di(3-methylphenoxy)ethane, 1,2-dipenoxyethane, 1-phenoxy-2-(4-methylphenoxy)ethane, terephthalic acid dimethyl ester, terephthalic acid dibutyl ester, terephthalic acid dibenzyl ester, p-benzyl-biphenyl, 1,4-dimethoxynaphthalene, 1,4-diethoxynaphthalene, 1-hydroxynaphthoic acid phenyl ester, etc.; various kinds of known thermoplastic substances, and inorganic pigments such as kaoline, clay, talc, calcium carbonate, calcined clay, titanium oxide, diatomaceous earth, fine granular anhydrous silica, active clay, etc., can be added to the coating composition.

(3) Coating

There is no particular restriction on the manner of forming the thermosensitive recording layer 5 of the thermosensitive recording material 6 using the support 1 of this invention. For example, the thermosensitive recording layer 5 is formed by coating the coating composition using air knife coating, blade coating, etc., followed by drying. Also, there is no paticular restriction on the coating amount of the coating composition but the amount is usually in the range of from 2 to 12 g/m$^2$, and preferably from 3 to 10 g/m$^2$, on a dry basis.

In addition, on the thermosensitive recording layer 5 of the thermosensitive recording material 6 may be formed an overcoat layer for the purposes of protecting the recording layer, etc., and also various known techniques in the field of producing thermosensitive recording material 6, such as an application of an adhesive treatment to the back surface of the thermosensitive recording material 6 to convert the thermosensitive recording material into an adhesive label, etc., can be employed as the case may be. Then, the invention is explained more specifically by referring to the following examples and comparison examples. Unless otherwise indicated, all parts, percents, ratios and the like are by weight.

The various properties in the examples and comparison examples were measured by the following methods.

Compression Ratio

The compression ratio was obtained from the following equation using the compressed thickness (μm) when a load of 32 kg/cm$^2$ was applied;

Compression ratio (%) $=A/B \times 100$

A: Compressed thickness (μm)

B: Thickness of sample (μm)

Center Line Average Roughness

The center line average roughness (Ra) was obtained by measurement with a three-dimensional roughness measurement means (SE-3AK, trade name, manufactured by Kosaka Kenkyusho K.K.) and an analyzer (Model SPA-11, trade name, made by Kosaka Kenkyusho K.K.).

Thermal Shrinkace

The thermal shrinkage was obtained by the following equation from the lengths of the sample before and after heating it in an oven of 120° C. for 30 minutes.

Thermal Shrinkage (%) $=C/D \times 100$

C Change in the length (length before heat treatment − length after heat treatment) by heat treatment at 120° C. for 30 minutes.

D: Length of sample before heat treatment at 120° C. for 30 minutes.

Production of Thermosensitive Recording Material (Application Example)

An aqueous coating composition formed by mixing a polyethyleneimine anchoring material and silica for preventing blocking was coated on the outermost surface layer (A) [(B) in the case of single layer stretched film]of each of the synthetic papers (supports) obtained in the examples and comparison examples to form an anchor coat layer, and after coating thereon the coating composition for the photosensitive recording layer prepared as described above at a dry coated amount of 5 g/m$^2$ followed by drying, the coated sheet was subjected to super calendering to provide a thermosensitive recording material.

High-Speed Printing Property

The surface of 100 sheets of the thermosensitive recording materials in case was printing using a printer (dot density =8 dots/mm, applied electric power =0.19 W/dot) manufactured by Okura Denki K.K. at 5 seconds, 30 seconds, or 60 seconds and the printing property was evaluated by the number of missed sheets in this case.

Printability

Figure 2:
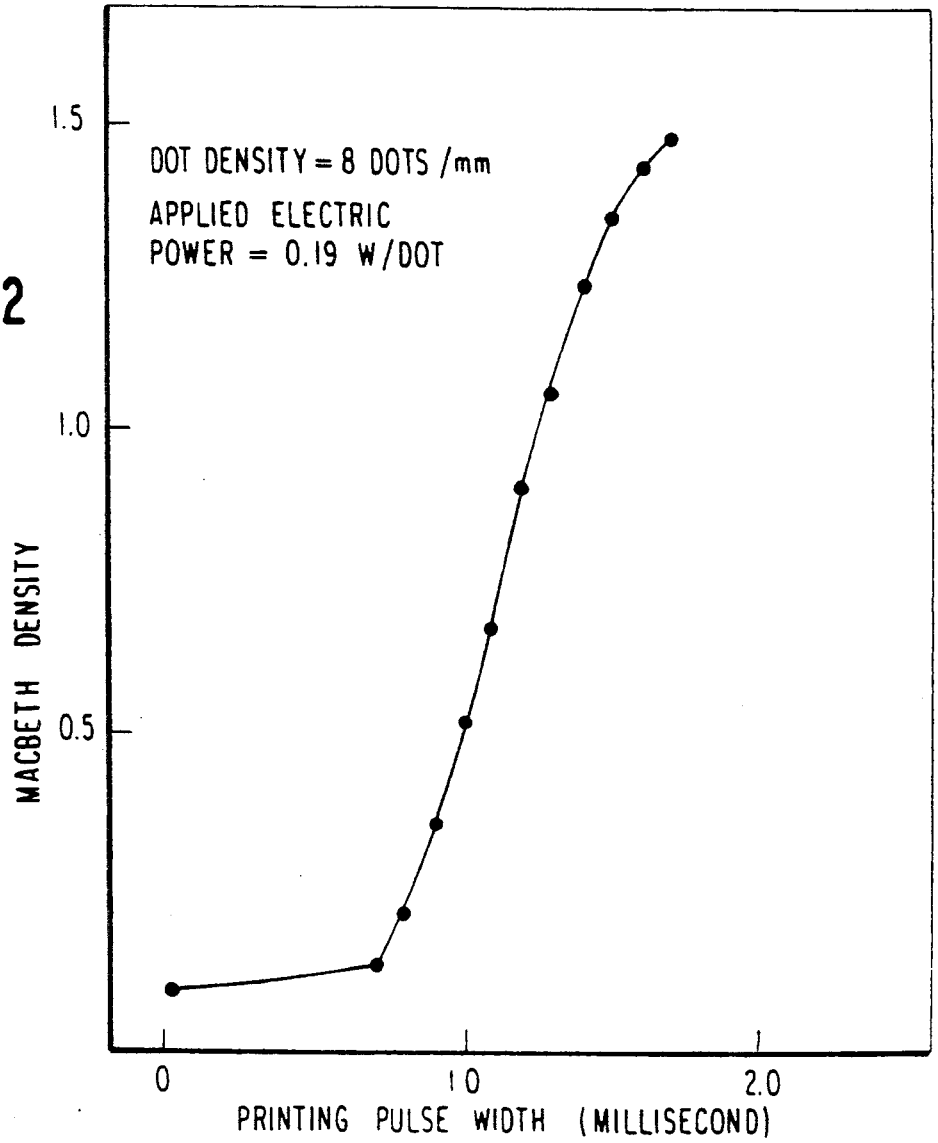
FIG. 2 is a graph showing the relationship between the pulse width of a recording head and the Macbeth density of a print printed on the thermosensitive recording material.

By printing on the surface of the thermosensitive recording material using a printer (dot density =8 dots/mm, applied electric power =0.19 W/dot) manufactured by Okura Denki K.K. while changing the printing pulse width, a Macbeth density was determined (see FIG. 2). The Macbeth densities (highlight portion) at a pulse width of 0.8 millisecond are shown in Table 1 below.

Also, the gradation of the print obtained was visually evaluated using the following five grades.

5: Very good
4: Good
3: No problems in practical use
2: Problems in practical use
1: No good Print Curling After printing the surface of each of the thermosensitive recording materials using a printer (dot density =8 dots/mm, applied electric power =0.19 W/dot) at a print pulse width of 1.7 millisecond, the recording material was cut into a sheet of 5 cm ×5 cm and the height of the curling at the four corners was evaluated by the following five ranks.

5: Very good. (No curling.)
4: Good. (Scarcely curled.)
3: Curled a little but no problems in practical use.
2: Curled to a great extent to cause problems in practical use.
1: No good. (Unsuitable in practical use.)

EXAMPLE 1

After melt-kneading each of Composition (A) formed by compounding 3% by weigh heavy calcium carbonate having a mean particle size of 1.5 μm with 97% by weight polypropylene (melting point of from 164° C. to 167° C.) having a melt index (MI) of 4 g/10 min., Composition (B) formed by compounding 10% by weight calcium carbonate having a mean particle size of 1.5 μm with a mixture of 85% by weight polypropylene having MI of 0.8 g/10 min. and 5% by weight high-density polyethylene (0.950 g/cm$^3$), and Composition (C) formed by compounding 3% by weight calcium carbonate having a mean particle size of 1.5 μm with 97% by weight polypropylene having MI of 4 g/10 min. each using a separate extruder at 260° C., each kneaded mixture was supplied to one co-extruding die, in which they were laminated in a molten condition, and the laminate was extruded at a temperature of 250° C. and cooled to a temperature of about 60° C. by a cooling roll.

After heating the laminate to 145° C., the laminate was stretched 5 times in the longitudinal direction (MD direction) utilizing the difference in peripheral speeds of a number of roll groups. After heating again the laminate to about 162° C., the laminate was stretched 8.5 times in the width direction (TD direction) at 162° C. using a tenter, after annealing the laminate at 165° C., the laminate was cooled to 60° C., and edge portions were slit to provide a synthetic paper (support) having a three layer structure (A/B/C =1.0 μm/78 μm/1.0 μm). The density of the support was 0.67 g/cm$^3$, the opacity thereof was 82%, the amount of voids therein was 30%, the compression ratio was 27%, the whiteness was 97%, the thermal shrinkage 2.3% in the MD direction and 1.5% in the TD direction, the Bekk smoothness was 4,500 seconds, and the center line average roughness (Ra) was 0. 39 μm.

EXAMPLE 2

The following the same procedure as in Example 1 except that the annealing treatment condition was changed to 170° C., the support having the properties shown in Table 1 below was produced.

EXAMPLES 3 TO 7, COMPARISON EXAMPLES 1 AND 3

By following the same procedure as in Example 1 except that the composition of each layer of the support and the opening of the die were changed, the supports having the properties shown in Table 1 below was produced.

COMPARISON EXAMPLE 2

By following the same procedure as in Example 1 except that the annealing treatment condition was changed to 160° C., the support having the properties shown in Table 1 below was produced.

COMPARISON EXAMPLE 4

Composition (B) composed of 65% by weight polypropylene having MI of 0.8 g/10 min., 10% by weight of high-density polyethylene (0.950 g/cm$^3$), and 25% by weight heavy calcium carbonate having a mean particle size of 1.5 μm was extruded using an extruder in a sheet form at 250° C. and the sheet was cooled to about 60° C. with a cooling roll.

After heating the sheet to 150° C., the sheet was stretched 5 times in the longitudinal direction utilizing the difference in peripheral speeds of a number of roll groups. After heating again the sheet to about 162° C., the sheet was stretched 7.5 times in the width direction at 162° C. using a tenter, and after annealing the sheet at 165° C., the sheet was cooled to 60° C. The edge portions were cut off to produce a biaxially stretched film having a thickness of 80 μm.

COMPARISON EXAMPLE 5

By following the same procedure as in Comparison Example 4 except that Composition (B) composed of 92% by weight of polypropylene, 5% by weight of high-density polyethylene (0.90 g/cm$^3$) and 3% by weight heavy calcium carbonate was used as the composition, a biaxially stretched film was produced.

EXAMPLE 8

By following the same procedure as in Example 1 except that talc having a mean particle size of 2.0 μm was used in place of heavy calcium carbonate to provide the composition shown in Table 1 below, a synthetic paper with a three layer structure was produced.

EXAMPLE 9

By following the same procedure as in Example 1 except that calcined clay having a mean particle size of 0.8 m was used in place of heavy calcium carbonate, a synthetic paper with a three-layer structure was obtained.

EXAMPLE 10

By laminating the support of the three-layer structure (A)/(B)/(C) obtained in Example 1 on both the surfaces of a wood free paper having a thickness of 40 μm using an adhesive, a support for dye transfer type thermosensitive recording having the structure of (A)/B)/(C)/(-wood free paper)/(A)/(B)/(C) in this order and having a density of 0.85 g/cm: was obtained.

When the thermosensitive layer was formed on layer (A) side of the support to produce a dye transfer type thermosensitive recording material and the properties thereof were evaluated, the print had a good gradation (Macbeth density =0.24, grade 5) and no curling occurred even after printing (grade 5).

EXAMPLE 11

By following the same procedure as in Example 1 except that 100% by weight a polypropylene resin having a MI of 4 g/10 min. was used in place of each of Composition (A) and Composition (B), a synthetic paper with three-layer structure was obtained.

The structures, compositions, and properties of the supports (including the properties of the thermosensitive recording materials using these supports) produced above in Examples 1 to 9, Comparison Examples 1 to 5, and Example 11 are shown in Table 1 below.

TABLE 1

| | Surface Layer (A) | | Base Material Layer (B) | | | Back Surface Layer (C) | | Thickness of Each Layer |
|---|---|---|---|---|---|---|---|---|
| | PP (wt %) | Inorganic Filler (wt %) | PP (wt %) | HDPE (wt %) | Inorganic Filler (wt %) | PP (wt %) | Inorganic Filler (wt %) | A/B/C (μm) |
| Example 1 | 97 | 3 ($CaCO_3$) | 85 | 5 | 10 ($CaCO_3$) | 97 | 3 ($CaCO_3$) | 1.0/78/1.0 |

TABLE 1-continued

| | | | | | | | | |
|---|---|---|---|---|---|---|---|---|
| 2 | 97 | 3 ($CaCO_3$) | 85 | 5 | 10 ($CaCO_3$) | 97 | 3 ($CaCO_3$) | 1.0/78/1.0 |
| 3 | 97 | 3 ($CaCO_3$) | 85 | 5 | 10 ($CaCO_3$) | 97 | 3 ($CaCO_3$) | 0.5/79/0.5 |
| 4 | 97 | 3 ($CaCO_3$) | 85 | 5 | 10 ($CaCO_3$) | 97 | 3 ($CaCO_3$) | 1.5/77/1.5 |
| 5 | 97 | 3 ($CaCO_3$) | 85 | 5 | 10 ($CaCO_3$) | — | — | 1.0/79/— |
| 6 | 85 | 15 ($CaCO_3$) | 85 | 5 | 10 ($CaCO_3$) | 97 | 3 ($CaCO_3$) | 1.0/78/1.0 |
| 7 | 97 | 3 ($CaCO_3$) | 65 | 10 | 25 ($CaCO_3$) | 97 | 3 ($CaCO_3$) | 1.0/78/1.0 |
| 8 | 85 | 15 (Talc) | 65 | 10 | 25 (Talc) | 85 | 15 (Talc) | 1.0/78/1.0 |
| 9 | 87 | 3 (Calcined Clay) | 85 | 5 | 10 (Calcined Clay) | 97 | 3 (Calcined Clay) | 1.0/78/1.0 |
| Comp. Exam. 1 | 100 | — | 85 | 5 | 10 ($CaCO_3$) | 97 | 3 ($CaCO_3$) | 1.0/78/1.0 |
| 2 | 97 | 3 ($CaCO_3$) | 85 | 5 | 10 ($CaCO_3$) | 97 | 3 ($CaCO_3$) | 1.0/78/1.0 |
| 3 | 97 | 3 ($CaCO_3$) | 85 | 5 | 10 ($CaCO_3$) | 97 | 3 ($CaCO_3$) | 20/30/20 |
| 4 | — | — | 65 | 10 | 25 ($CaCO_3$) | — | — | —/80/— |
| 5 | — | — | 92 | 5 | 3 ($CaCO_3$) | — | — | —/80/— |
| Example 11 | 100 | — | 85 | 5 | 10 ($CaCO_3$) | 100 | — | 1.0/78/10 |

| | Property of Surface Layer (A) | | Property of Support | | | | | | Thermosensitive Recording Material | | |
|---|---|---|---|---|---|---|---|---|---|---|---|
| | Smoothness (sec.) | Roughness (μm) | Opacity (%) | Amount of Voids (%) | Compression Ratio (%) | Density ($g/cm^2$) | Thermal Shrinkage MD (%) | Thermal Shrinkage TD (%) | *1 | *2 | *3 |
| Examp. 1 | 4,500 | 0.39 | 82 | 30 | 27 | 0.67 | 2.3 | 1.5 | 4 | 0.22 | 5 |
| 2 | 4,500 | 0.39 | 82 | 31 | 27 | 0.66 | 1.0 | 0.7 | 5 | 0.21 | 5 |
| 3 | 3,000 | 0.44 | 82 | 32 | 29 | 0.65 | 1.0 | 0.7 | 5 | 0.20 | 5 |
| 4 | 6,000 | 0.32 | 81 | 29 | 25 | 0.68 | 0.9 | 0.6 | 5 | 0.23 | 5 |
| 5 | 4,500 | 0.39 | 81 | 31 | 28 | 0.66 | 1.0 | 0.7 | 5 | 0.22 | 5 |
| 6 | 1,500 | 0.58 | 85 | 32 | 30 | 0.65 | 1.0 | 0.7 | 5 | 0.20 | 5 |
| 7 | 4,450 | 0.44 | 88 | 45 | 31 | 0.59 | 0.8 | 0.5 | 5 | 0.22 | 4 |
| 8 | 6,200 | 0.30 | 78 | 26 | 20 | 0.80 | 0.5 | 0.3 | 5 | 0.20 | 4 |
| 9 | 2,700 | 0.45 | 79 | 31 | 27 | 0.66 | 1.5 | 1.0 | 4 | 0.20 | 5 |
| Comp. Examp. 1 | 10,000 | 0.20 | 80 | 30 | 25 | 0.67 | 1.0 | 0.7 | 5 | 0.12 | 2 |
| 2 | 4,500 | 0.39 | 82 | 30 | 27 | 0.67 | 3.5 | 2.7 | 1 | 0.21 | 5 |
| 3 | 9,500 | 0.21 | 55 | 27 | 12 | 0.70 | 1.0 | 0.7 | 5 | 0.11 | 1 |
| 4 | 700 | 0.68 | 89 | 45 | 36 | 0.59 | 0.8 | 0.5 | 5 | 0.12 | 2 |
| 5 | 8,500 | 0.23 | 56 | 14 | 10 | 0.79 | 1.1 | 0.8 | 5 | 0.10 | 2 |
| Examp. 11 | 7,200 | 0.31 | 90 | 28 | 26 | 0.70 | 1.0 | 0.7 | 5 | 0.23 | 5 |

*1: Print curling
*2: Macbeth Density
*3: Gradation

EXAMPLE 12

By laminating the support of the three-layer structure (A)/(B)/(C) obtained in Example 11 on both the surfaces of a wood free paper having a thickness of 40 μm using an adhesive such that the outermost layer of the printing surface side became layer (A) and the outermost layer of the back surface side became layer (C), a support with a structure of (A)/(B)/(C)/(wood free paper)/(A)/(B)/ (C) and having a density of 0.85 $g/cm^3$ was obtained.

When the thermosensitive recording layer was formed on the layer (A) to provide a thermosensitive recording material and the properties thereof were evaluated, the print obtained had a good gradation (Macbeth density =0.23, grade 5) and no curling occurred (grade 5).

EXAMPLE 13

After melt-kneading each of Composition (A) formed by compounding 97% by weight polypropylene (melting point of from 164° C. to 167° C.) having MI of 4 g/10 min. with 3% by weight heavy calcium carbonate having a mean particle size of 1.5 μm, Composition (B) formed by compounding a mixture of 85% by weight polypropylene having MI of 0.8 g/10 min. and 5% by weight high-density polyethylene (0.950 $g/cm^3$) with 10% by weight calcium carbonate having a mean particle size of 1.5 μm, and Composition (C) formed by compounding 55% by weight polypropylene having MI of 4 g/10 min. with 45% by weight calcium carbonate having a mean particle size of 1.5 μm using a separate extruder for each at 260° C., each of these melt-kneaded composition was supplied to one co-extruding die, wherein they were laminated together in the molten states, they were extruded at 250° C. and cooled to about 60° C.

After heating the laminate to a temperature of 145° C., the laminate was stretched 5 times in the longitudinal direction (MD direction) utilizing the difference in peripheral speeds of a number of roll groups. After heating again the laminate to a temperature of about 162° C., the laminate was stretched 8.5 times in the width direction (TD direction) at 162° C. using a tenter, and the laminate was annealed at 165° C. Thereafter, the laminate was cooled to a temperature of 60° C. and edge portions were slit to provide a synthetic paper (support) with a three-layer structure [(A)/(B)/(C) =1.0 μm/78 μm/1.0 μm].

The density of the support was 0.67 $g/cm^3$, the opacity thereof was 92%, the amount of voids therein was 30%, the compression ratio was 27%, and the kinetic friction coefficient as the back surface property was 0.80.

EXAMPLES 14 TO 18, COMPARISON EXAMPLE 6 AND 7

By following the same procedure as in Example 13 except that the composition of each layer of the support was changed as shown in Table 2 below and the opening of the die was changed, supports having the properties shown in Table 2 below were produced.

COMPARISON EXAMPLE 8

Composition (B) formed by compounding a mixture of 45% by weight of polypropylene having MI of 0.8 g/10 min. and 10% by weight high-density polyethylene (0.950 g/cm$^3$) with 45% by weight heavy calcium carbonate having a mean particle size of 1.5 μm was extruded into sheet form at 250° C. using an extruder and cooled to a temperature of about 60° C. with a cooling roll.

After heating the sheet to 150 ° C., the sheet was stretched 5 times in the longitudinal direction (MD direction) utilizing the difference in the peripheral speeds of a number of roll groups. After heating again the to a temperature of about 162° C., the sheet was stretched 7.5 times in the width direction at 162° C. using a tenter. Thereafter, the sheet was annealed at 165° C., cooled to 60° C., and the edge portions were slit to provide a biaxially stretched film with a thickness of 80 μm.

COMPARISON EXAMPLE 9

By following the same procedure as in Comparison Example 8 except that Composition (B) formed by compounding a mixture of 85% by weight polypropylene and 5% by weight high-density polyethylene (0.950 g/cm$^3$) with 10% by weight heavy calcium carbonate was used as the composition, a biaxially stretched film was produced.

EXAMPLE 19

By following the same procedure as in Example 13 except that talc having a mean particle size of 2.0 μm was used in place of heavy calcium carbonate, a synthetic paper of a three-layer structure was obtained.

EXAMPLE 20

By following the same procedure as in Example 13 except that calcined clay having a mean particle size of 0.8 μm was used in place of heavy calcium carbonate, a synthetic paper with a three-layer structure was produced.

EXAMPLE 21

By laminating the support having with the three-layer structure (A)/(B)/(C) obtained as in Example 13 on both surfaces of a wood free paper having a thickness of 40 μm using an adhesive such that the outermost layer of the printing surface side became layer (A) and the outermost layer of the back surface side became layer (C), a support for thermosensitive recording having the structure of (A)/(B)/(C)/(wood free paper)-/(A)/(B)/(C) and having a density of 0.85 g/cm$^3$ was obtained.

When the thermosensitive recording layer was formed on the layer (A) side to produce a thermosensitive recording material and the properties were evaluated, a high-speed printing property (printing speed: 5 seconds, 30 seconds, and 60 seconds, each case no miss prints) was obtained, a good printing power (grade 5) resulted, and no curling occurred even after printing (grade 5).

EXAMPLE 22

By following the same procedure as in Example 13 except that 100% of a polypropylene resin having MI of 4 g/10 min. was used in place of Composition (A), a synthetic paper with a three-layer structure was produced.

The structures, compositions, and properties (including the properties of the thermosensitive recording materials) of the supports obtained in Examples 13 to 20, Comparison Examples 6 to 9, and Example 22 are shown in Table 2 below.

EXAMPLE 23

By laminating the support with the three-layer structure (A)/(B)/(C) obtained in Example 22 on both surfaces of a wood free paper having a thickness of 40 μm using an adhesive such that the outermost layer of the printing surface side became layer (A) and the outermost layer of the back surface side became layer (C), a support for thermosensitive recording with the structure of (A)/(B)/(C)/(wood free paper)/(A)/(B)/(C) and having a density of 0.85 g/cm$^3$ was obtained.

When the thermosensitive recording layer was formed on the layer (A) side to provide a thermosensitive recording material and the properties were evaluated, a high-speed printing property (printing speed: 5 seconds, 30 seconds, and 60 seconds, each case no miss prints) was obtained, a good printing power (grade 5) resulted, and no curling occurred (grade 5).

TABLE 2

| | Surface (A) | | Base Material Layer (B) | | | Back Layer (C) | | Thickness of each Layer A/B/C (μm) |
|---|---|---|---|---|---|---|---|---|
| | PP (wt %) | Inorganic Filler (wt %) | PP (wt %) | HDPE (wt %) | Inorganic Filler (wt %) | PP (wt %) | Inorganic Filler (wt %) | |
| Example 13 | 97 | 3 ($CaCO_3$) | 85 | 5 | 10 ($CaCO_3$) | 55 | 45 ($CaCO_3$) | 1.0/78/1.0 |
| Example 14 | 97 | 3 ($CaCO_3$) | 85 | 5 | 10 ($CaCO_3$) | 65 | 35 ($CaCO_3$) | 1.0/78/1.0 |
| Example 15 | 97 | 3 ($CaCO_3$) | 65 | 10 | 25 ($CaCO_3$) | 55 | 45 ($CaCO_3$) | 1.0/78/1.0 |
| Example 16 | — | — | 85 | 5 | 10 ($CaCO_3$) | 55 | 45 ($CaCO_3$) | —/79/1.0 |
| Example 17 | 97 | 3 ($CaCO_3$) | 85 | 5 | 10 ($CaCO_3$) | 55 | 45 ($CaCO_3$) | 1.5/77/1.5 |
| Example 18 | 97 | 3 ($CaCO_3$) | 85 | 5 | 10 ($CaCO_3$) | 55 | 45 ($CaCO_3$) | 0.5/79/0.5 |
| Example 19 | 97 | 3 (Talc) | 85 | 5 | 10 (Talc) | 55 | 45 (Talc) | 1.0/78/1.0 |
| Example 20 | 97 | 3 (Calcined Clay) | 85 | 5 | 10 (Calcined Clay) | 55 | 45 (Calcined Clay) | 1.0/78/1.0 |
| Comp. Examp. 6 | 97 | 3 ($CaCO_3$) | 85 | 5 | 10 ($CaCO_3$) | 55 | 45 ($CaCO_3$) | 20/40/20 |
| Comp. Examp. 7 | 97 | 3 ($CaCO_3$) | 85 | 5 | 10 ($CaCO_3$) | 90 | 10 ($CaCO_3$) | 1.0/78/1.0 |
| Comp. Examp. 8 | — | — | 45 | 10 | 45 ($CaCO_3$) | — | — | —/80/— |
| Comp. Examp. 9 | — | — | 85 | 5 | 10 ($CaCO_3$) | — | — | —/80/— |
| Example 22 | 100 | — | 85 | 5 | 10 ($CaCO_3$) | 55 | 45 ($CaCO_3$) | 1.0/78/1.0 |

| | Property of Back Layer | Property of Thermosensitive Recording Material |
|---|---|---|
| | | High-Speed |

TABLE 2-continued

| | (C) Kinetic Friction Coefficient | Property of Support: Density (g/cm³) | Opacity (%) | Amount of Voids (%) | Compression Ratio (%) | Thermal Shrinkage: MD (%) | TD (%) | Surface Layer (A): Smoothness (sec) | Roughness (μm) | Printing Property* Printing Speed: 5 sec. | 30 sec. | 60 sec. | *1 | *2 | *3 |
|---|---|---|---|---|---|---|---|---|---|---|---|---|---|---|---|
| Example 13 | 0.80 | 0.67 | 92 | 30 | 27 | 1.0 | 0.7 | 4,500 | 0.39 | 0 | 0 | 0 | 0.22 | 5 | 5 |
| Example 14 | 1.00 | 0.68 | 90 | 29 | 25 | 1.0 | 0.7 | 4,500 | 0.39 | 0 | 0 | 0 | 0.21 | 5 | 5 |
| Example 15 | 0.85 | 0.60 | 93 | 44 | 31 | 0.8 | 0.5 | 4,450 | 0.44 | 0 | 0 | 0 | 0.22 | 5 | 5 |
| Example 16 | 0.82 | 0.67 | 92 | 30 | 27 | 1.0 | 0.7 | 1,500 | 0.58 | 0 | 0 | 0 | 0.20 | 4 | 4 |
| Example 17 | 0.95 | 0.68 | 91 | 29 | 27 | 0.9 | 0.6 | 6,000 | 0.32 | 0 | 0 | 0 | 0.23 | 5 | 5 |
| Example 18 | 1.05 | 0.67 | 91 | 30 | 27 | 1.0 | 0.7 | 3,000 | 0.44 | 0 | 0 | 0 | 0.20 | 5 | 5 |
| Example 19 | 1.00 | 0.80 | 83 | 17 | 21 | 0.5 | 0.3 | 7,500 | 0.30 | 0 | 0 | 0 | 0.20 | 4 | 5 |
| Example 20 | 1.00 | 0.66 | 85 | 31 | 26 | 1.5 | 1.0 | 2,700 | 0.45 | 0 | 0 | 0 | 0.20 | 5 | 5 |
| Comp. Examp. 6 | 0.70 | 0.62 | 92 | 35 | 32 | 1.0 | 0.7 | 9,500 | 0.21 | 0 | 0 | 0 | 0.11 | 1 | 5 |
| Comp. Examp. 7 | 1.40 | 0.68 | 90 | 23 | 24 | 1.0 | 0.7 | 4,500 | 0.39 | 30 | 26 | 20 | 0.21 | 5 | 5 |
| Comp. Examp. 8 | 0.60 | 0.55 | 92 | 54 | 38 | 0.8 | 0.5 | 500 | 0.72 | 0 | 0 | 0 | 0.12 | 1 | 4 |
| Comp. Examp. 9 | 1.30 | 0.65 | 85 | 32 | 27 | 1.1 | 0.8 | 1,500 | 0.58 | 27 | 21 | 18 | 0.20 | 4 | 5 |
| Example 22 | 0.80 | 0.69 | 91 | 29 | 26 | 1.0 | 0.7 | 7,200 | 0.31 | 0 | 0 | 0 | 0.23 | 5 | 5 |

*1: Macbeth Density
*2: Gradation
*3: Curling After Printing
*On to each surface of 100 sheets of the thermosensitive materials was applied printing at each printing speed and the printing property was evaluated by the number of missed sheet.

While the invention has been described in detail and with reference to specific embodiments thereof, it will be apparent to one skilled in the art that various changes and modifications can be made therein without departing from the spirit and scope thereof.

What is claimed is:

1. A support for a thermosensitive recording material comprising a surface layer of a thermoplastic resin film having a center line average roughness of 0.6 μm or less laminated on the surface of a porous film base material of a biaxially stretched film of a thermoplastic resin containing an inorganic fine powder, wherein the properties of said support meet the following conditions (a) to (c);

(a) the thickness of the surface layer is from 0. 3 to 2.0 μm and the Bekk smoothness of the surface layer is from 1,000 to 8,000 seconds, (b) the opacity of the support is at least 70% the density of the support is 0.91 g/cm³ or less, and the compression ratio of the support under a stress of 32 kg/cm² is from 15 to 35%, and (c) the coefficient of thermal shrinkage at 120° C. for 30 minutes is 2.5% or less in the longitudinal direction and is 2.0% or less in the width direction.

2. A support for a thermosensitive recording material comprising a surface layer composed of a thermoplastic resin film having a center line average roughness of 0.6 μm or less laminated on one surface, as a front surface, of a porous film base material of a biaxially stretched film of a thermoplastic resin containing an inorganic fine powder and a surface layer of a thermoplastic resin film having a kinetic friction coefficient of from 0. 3 to 1.2 laminated on the opposite surface, as a back surface layer, of the base material, wherein the properties of said support meet the following conditions (a) to (d);

(a) the thickness of the front surface layer is from 0. 3 to 2.0 μm and the Bekk smoothness of the front surface layer is from 1,000 to 8,000 seconds, (b) the opacity of the support is at least 70% the density of the support is 0.91 g/cm: or less and the compression ratio of the support under a stress of 32 kg/cm² is from 15 to 35%, (c) the coefficient of thermal shrinkage at 120° C. for 30 minutes is 2.5% or less in the longitudinal direction and is 2.0% or less in the width direction, and (d) the thickness of the back surface layer is from 0. 3 to 2.0 μm.

* * * * *